United States Patent [19]

Belovarac

[11] Patent Number: 4,938,172

[45] Date of Patent: Jul. 3, 1990

[54] SUPPLEMENT SYSTEM FOR TRANSFERRING HEAT FROM A FURNACE EXHAUST STACK TO A HOT WATER TANK

[76] Inventor: Matthew Belovarac, 607 E. 31 St., Erie, Pa. 16504

[21] Appl. No.: 299,840

[22] Filed: Jan. 19, 1989

[51] Int. Cl.[5] ..... F22B 33/00

[52] U.S. Cl. ..... 122/20 B; 126/365; 237/19; 237/55; 237/8 R

[58] Field of Search ..... 237/19, 55, 8 R; 122/20 B; 126/364, 365

[56] References Cited

U.S. PATENT DOCUMENTS 4,136,731 1/1979 De Boer ..... 237/19 X 4,417,546 11/1983 Hoskinson ..... 237/19 X

*Primary Examiner*—Henry A. Bennet
*Assistant Examiner*—John Sollecito
*Attorney, Agent, or Firm*—Ralph Hammar

[57] ABSTRACT

A supplementary hot water heating system which transfers to a hot water tank heat from exhaust gas in the furnace stack which would otherwise be wasted. When the water in the supplementary heater core is heated to a desired temperature, normally closed valves, one connecting the heater core to the cold waterline and the other connecting the bottom of the hot water tank to a drain, are simultaneously opened and remain opened until the supplementary heater core is again filled with cold water from the cold water line.

3 Claims, 1 Drawing Sheet

FIG. 1
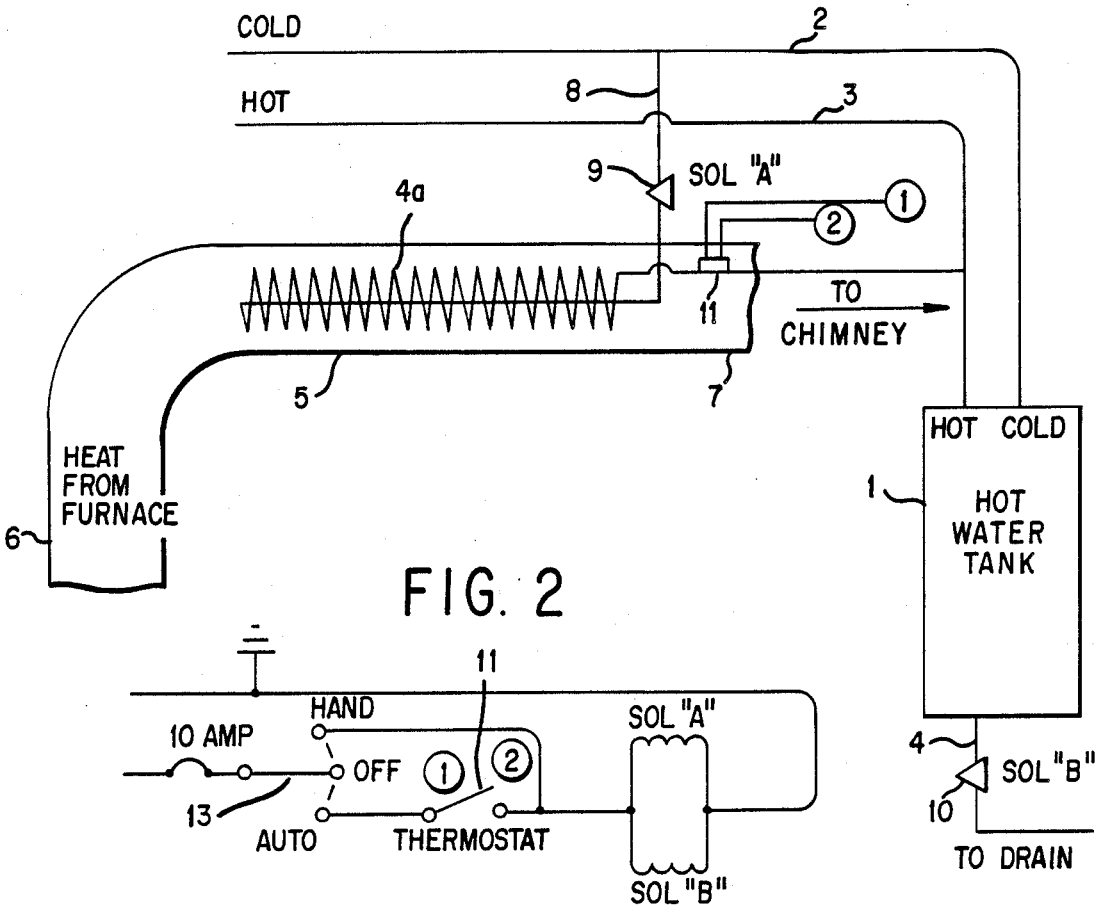
FIG. 2
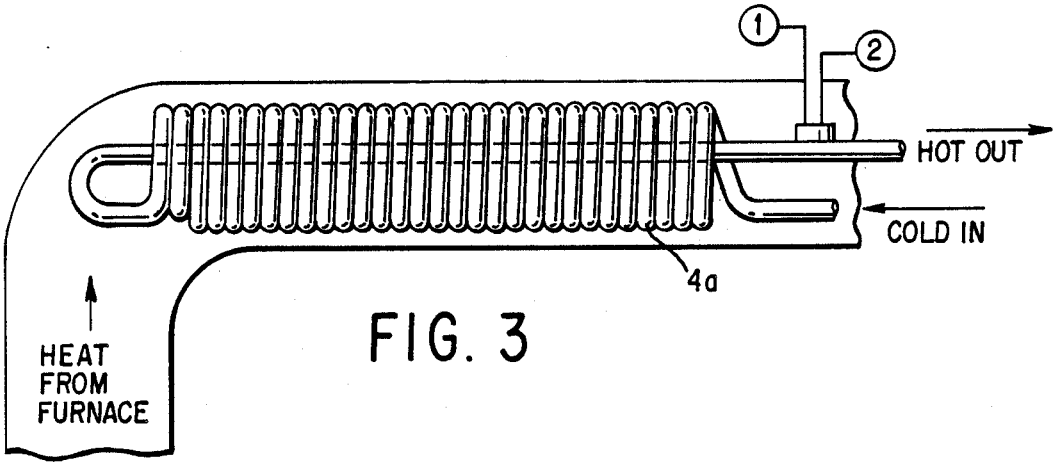
FIG. 3

SUPPLEMENT SYSTEM FOR TRANSFERRING HEAT FROM A FURNACE EXHAUST STACK TO A HOT WATER TANK

This invention is a supplementary hot water heating system which uses flue gas in the furnace exhaust stack to heat hot water.

In the drawing, FIG. 1 shows a supplementary hot water heating system connected to the hot and cold lines of a hot water heater, FIG. 2 is a circuit diagram and FIG. 3 shows a supplementary heater core installed in a pipe.

Referring to the drawings, 1 indicates a conventional hot water tank connected to cold water line 2, hot water line 3 and drain line 4. The hot water tank is or may be of common construction.

The supplementary heater core 4a is mounted in a pipe 5 having one end 6 connected to receive hot exhaust gases from the furnace and the other end 7 connected to the chimney or furnace exhaust stack. The incoming flow of cold water through line 8 is controlled by normally closed solenoid valve 9. Drainage of water from the hot water tank 1 is controlled by normally closed solenoid valve 10.

Thermostat 11 which responds to the temperature of the hot water in core 4a simultaneously operates solenoid valves 9 and 10 to connect the heater core 4a to the hot water line of the tank 1 and to open the drain 4 from the hot water tank 1. Withdrawing cool water from the bottom of the tank 1 allows hot water from the core 4a to enter the top of the tank. The water which flows from the core to replace water withdrawn from the hot water tank through valve 10 is replaced in the core by cold water from line 8. As soon as the cold water reaches the thermostat 11, the thermostat opens the circuit to the solenoids 9 and 10 thereby returning valves 9 and 10 to the normally closed position. During cold weather, the supplementary heating system can supply a large proportion of the hot water requirements. During hot weather when the furnace is not operating, the supplementary heating system of course does not supply any hot water to the hot water tank 1.

The selector switch 13 in the "off" position disconnects the supplementary heating system during the summer when the furnace is not operating. In the "hand" position, the solenoid valves may be opened and closed by hand. In the "automatic" position the supplementary system operates as described above. "Automatic" would be the normal position for the selector switch during the winter.

I claim:

1. A supplementary heating system for a hot water heater tank having a cold water line to the tank, a hot water line from the tank, and a drain line from the lower part of the tank, a heat exchanger adapted to be mounted in heat exchange relation to hot exhaust gases from a furnace exhaust stack, said heat exchanger having an inlet connected to said cold water line and an outlet connected to said hot water line, and means for draining water from said drain line to permit flow of heated water from said heat exchanger into said tank in response to the temperature of water in said heat exchanger.

2. The structure of claim 1 in which the means for draining water from the drain line is simultaneously operable valves in said inlet to said heat exchanger and in said drain line.

3. The structure of claim 2 in which the valves are normally closed solenoid valves opened by a thermostat responsive to the temperature of the hot water in said heat exchanger.

* * * * *